US010522123B2

(12) United States Patent
Kim

(10) Patent No.: US 10,522,123 B2
(45) Date of Patent: Dec. 31, 2019

(54) ELECTRONIC APPARATUS AND CONTROL METHOD THEREOF

(71) Applicant: SAMSUNG ELECTRONICS CO., LTD., Suwon-si (KR)

(72) Inventor: Jong-woo Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/869,774

(22) Filed: Jan. 12, 2018

(65) Prior Publication Data

US 2018/0211643 A1 Jul. 26, 2018

(30) Foreign Application Priority Data

Jan. 26, 2017 (KR) ..... 10-2017-0012941

(51) Int. Cl.
*G10H 1/00* (2006.01)
*G10H 1/12* (2006.01)

(52) U.S. Cl.
CPC ..... *G10H 1/0008* (2013.01); *G10H 1/125* (2013.01); *G10H 2210/066* (2013.01); *G10H 2210/081* (2013.01); *G10H 2220/021* (2013.01); *G10H 2240/235* (2013.01); *G10H 2250/055* (2013.01); *G10H 2250/235* (2013.01); *G10H 2250/631* (2013.01)

(58) Field of Classification Search
CPC . G10H 1/0008; G10H 1/125; G10H 2210/066
USPC ..... 84/609
See application file for complete search history.

(56) References Cited

U.S. PATENT DOCUMENTS 4,399,732 A 8/1983 Rothschild et al.
5,150,413 A * 9/1992 Nakatani ..... G10L 15/00 704/249
5,756,918 A * 5/1998 Funaki ..... G10H 1/00 84/649
6,581,081 B1 * 6/2003 Messerly ..... G06F 17/148 708/316

(Continued)

FOREIGN PATENT DOCUMENTS

EP 2306453 B1 10/2015
JP 2001-125562 A 5/2001

(Continued)

OTHER PUBLICATIONS

Search Report dated Apr. 17, 2018, issued by the International Searching Authority in counterpart International Patent Application No. PCT/KR2018/000017 (PCT/ISA/210).

(Continued)

*Primary Examiner* — David S Warren
(74) *Attorney, Agent, or Firm* — Sughrue Mion, PLLC

(57) ABSTRACT

An electronic apparatus is disclosed, which includes an input interface configured to receive an audio signal, a processor configured to process the received audio signal, and an output interface configured to output the processed audio signal, in which the processor is configured to obtain a scale of a first octave by applying a filter bank to the audio signal based on a sampling frequency of the audio signal; down-sample the audio signal; and obtain a scale of a second octave lower than the first octave by applying the filter bank to the down-sampled signal.

18 Claims, 18 Drawing Sheets

(56) References Cited

U.S. PATENT DOCUMENTS 6,703,551 B2 * 3/2004 Ueshima ..... G10H 1/361 434/307 A
7,482,530 B2 * 1/2009 Kobayashi ..... G10G 3/04 382/239
7,829,778 B2 * 11/2010 Gatzsche ..... G09B 15/023 84/600
7,982,122 B2 * 7/2011 Gatzsche ..... G10H 1/0008 84/613
8,170,236 B2 5/2012 Kondo et al.
8,802,953 B2 * 8/2014 Bright ..... G10H 1/366 434/307 A
9,697,840 B2 * 7/2017 Biswas ..... G10L 25/54
2002/0170414 A1 * 11/2002 Ueshima ..... G10H 1/361 84/607
2005/0211077 A1 * 9/2005 Kobayashi ..... G10G 3/04 84/661
2005/0216259 A1 * 9/2005 Watts ..... H03H 17/02 704/205
2005/0228518 A1 * 10/2005 Watts ..... H03H 17/02 700/94
2008/0307945 A1 * 12/2008 Gatzsche ..... G09B 15/023 84/477 R
2009/0100990 A1 * 4/2009 Cremer ..... G10H 1/06 84/623
2009/0144064 A1 * 6/2009 Sakurai ..... G10L 21/04 704/503
2010/0280922 A1 11/2010 Giovannotto
2011/0144780 A1 * 6/2011 Ueshima ..... G06T 13/205 700/94
2013/0013262 A1 * 1/2013 Allegra ..... G01R 23/167 702/190
2014/0310011 A1 * 10/2014 Biswas ..... G10L 25/54 704/500
2014/0366710 A1 * 12/2014 Eronen ..... G10H 1/00 84/609
2016/0005387 A1 * 1/2016 Eronen ..... G10H 1/40 84/611
2017/0110141 A1 * 4/2017 Craven ..... G10L 19/26
2017/0331881 A1 * 11/2017 Chandramouli ..... G06F 16/221
2018/0174575 A1 * 6/2018 Bengio ..... G10L 15/16
2018/0204584 A1 * 7/2018 Cook ..... G10H 1/366
2018/0211643 A1 * 7/2018 Kim ..... G10H 1/125

FOREIGN PATENT DOCUMENTS

KR 10-0434692 B1 7/2004
KR 10-2008-0021201 A 3/2008
KR 10-0991464 B1 11/2010
KR 10-1158037 B1 6/2012
KR 20-2016-0002619 U 7/2016
WO 01/37499 A1 5/2001

OTHER PUBLICATIONS

Written Opinion dated Apr. 17, 2018, issued by the International Searching Authority in counterpart International Patent Application No. PCT/KR2018/000017 (PCT/ISA/237).
Communication dated Oct. 14, 2019, issued by the European Patent Office in counterpart European Application No. 18744770.1.

* cited by examiner

FIG. 4A (Unit: Hz)

| Scale \ Octave | 1 | 2 | 3 | 4 | 5 | 6 | 7 | 8 |
|---|---|---|---|---|---|---|---|---|
| C(Do) | 32.7032 | 65.4064 | 130.8128 | 261.6256 | 523.2511 | 1046.502 | 2093.005 | 4186.009 |
| C# | 34.6478 | 69.2957 | 138.5913 | 277.1826 | 554.3653 | 1108.731 | 2217.461 | 4434.922 |
| D(Re) | 36.7081 | 73.4162 | 146.8324 | 293.6648 | 587.3295 | 1174.659 | 2349.318 | 4698.636 |
| D# | 38.8909 | 77.7817 | 155.5635 | 311.1270 | 622.2540 | 1244.508 | 2489.016 | 4978.032 |
| E(Mi) | 41.2034 | 82.4069 | 164.8138 | 329.6276 | 659.2551 | 1318.510 | 2637.020 | 5274.041 |
| F(Fa) | 43.6535 | 87.3071 | 174.6141 | 349.2282 | 698.4565 | 1396.913 | 2793.826 | 5587.652 |
| F# | 46.2493 | 92.4986 | 184.9972 | 369.9944 | 739.9888 | 1479.978 | 2959.955 | 5919.911 |
| G(Sol) | 48.9994 | 9739989 | 195.9977 | 391.9954 | 783.9909 | 1567.982 | 3135.963 | 6271.927 |
| G# | 51.9130 | 103.8262 | 207.6523 | 415.3047 | 830.6094 | 1661.219 | 3322.438 | 6644.875 |
| A(La) | 55.0000 | 110.0000 | 220.0000 | 440.0000 | 880.0000 | 1760.000 | 3520.000 | 7040.000 |
| A# | 58.2705 | 116.5409 | 233.0819 | 466.1638 | 932.3275 | 1864.655 | 3729.310 | 7458.620 |
| B(Si) | 61.7354 | 123.4708 | 246.9417 | 493.8833 | 987.7666 | 1975.533 | 3951.066 | 7902.133 |

FIG. 4B

| An | X |
|---|---|
| B♭n | $X \times 2^{\frac{1}{12}}$ |
| Bn | $X \times 2^{\frac{1}{6}}$ |
| Cn | $X \times 2^{\frac{1}{4}}$ |
| C#n | $X \times 2^{\frac{1}{3}}$ |
| Dn | $X \times 2^{\frac{5}{12}}$ |
| E♭n | $X \times 2^{\frac{1}{2}}$ |
| En | $X \times 2^{\frac{7}{12}}$ |
| Fn | $X \times 2^{\frac{2}{3}}$ |
| F#n | $X \times 2^{\frac{3}{4}}$ |
| Gn | $X \times 2^{\frac{5}{6}}$ |
| G#n | $X \times 2^{\frac{11}{12}}$ |

ELECTRONIC APPARATUS AND CONTROL METHOD THEREOF

This application claims priority from Korean Patent Application No. 10-2017-0012941, filed on Jan. 26, 2017 in the Korean Intellectual Property Office, the disclosure of which is incorporated herein by reference in its entirety.

BACKGROUND

1. Field

Apparatuses and methods consistent exemplary embodiments relate to an electronic apparatus and a control method thereof, and more particularly to an electronic apparatus capable of detecting a music scale of an audio signal and a control method thereof.

2. Description of the Related Art

The related scale obtain methods include the Fourier transform-based (FFT-based) method of converting into the frequency domain, or the method of obtaining a self-correlation by giving input data a delay as much as the target pitch, for example.

In the FFT-based method, scales of wide octave bands may be obtained by a single computation, but a wide window may be required to obtain a sufficient resolution, and accordingly, a delay may be caused.

Meanwhile, the self-correlation method has a shortcoming because it may require the number of computations in proportion to the number of scales to be obtained, and it may be also difficult to obtain a sufficient resolution as the frequency increases, due to insufficient delay difference among scales. That is, there is a problem that accuracy of scale detection is deteriorated in a high frequency range.

SUMMARY

Exemplary embodiments address at least the above problems and/or disadvantages and other disadvantages not described above. Also, the exemplary embodiments are not required to overcome the disadvantages described above, and may not overcome any of the problems described above.

One or more exemplary embodiments an electronic apparatus capable of scale detection in a plurality of octaves by using the same digital filter and a control method thereof.

According to an aspect of an exemplary embodiment, there is provided an electronic apparatus including: an input interface configured to receive an audio signal, a processor configured to process the received audio signal, and an output interface configured to output the processed audio signal, in which the processor may apply a filter bank to an audio signal based on a sampling frequency of an received audio signal to obtain a scale of a first octave, and down-sample the audio signal and apply the filter bank to the down-sampled signal to obtain a scale of a second octave lower than the first octave.

The audio signal may be a compressed time-domain signal, the processor may decode the audio signal to acquire a pulse amplitude modulation (PAM) signal and information about a sampling frequency of the PAM signal, and convert the PAM signal into a frequency-domain signal and apply the filter bank to the frequency-domain signal based on the sampling frequency.

Further, the filter bank may include a plurality of digital filters for filtering a frequency band corresponding to each of the plurality of target scales.

The filter band may include a plurality of digital band pass filters having center frequencies that are set based on a sampling frequency of the audio signal and a plurality of frequencies corresponding to each of a plurality of scales of the first octave.

The plurality of digital band pass filters may have the plurality of frequencies as the center frequencies in a normalized frequency domain, and each of the center frequencies of the plurality of digital band pass filters may be reduced to half of the center frequencies when the sampling frequency is reduced to half of the sampling frequency.

The processor may be further configured to: obtain the scale of the second octave by applying the filter bank to the audio signal that is down-sampled by half; and obtain a scale of a third octave that is lower than the second octave by applying the filter bank to the audio signal that is down-sampled by one fourth. The second octave may be an octave lower than the first octave by one octave, and the third octave may be an octave lower than the second octave by one octave.

The first octave may be a highest octave of a plurality of target octaves, and the audio signal may be a signal sampled at two times the highest frequency of the first octave or higher.

The electronic apparatus may further include a display including a plurality of light emitting elements, and the processor may control an illuminating state of the plurality of light emitting elements based on a scale obtained from the processed audio signal.

The processor may control at least one of the illumination time of the light emitting elements, and a number and intensity of illuminations of the light emitting elements corresponding to the scales based on the octave of the scales obtained from the processed audio signal.

According to an aspect of another exemplary embodiment, there is provided a method of controlling an electronic apparatus, including: obtaining a scale of a first octave by applying a filter bank to an audio signal based on a sampling frequency of an audio signal; and down-sampling the audio signal, and obtaining a scale of a second octave that is lower than the first octave by applying the filter bank to the down-sampled signal.

The audio signal may be a compressed time-domain signal, and the method may further include decoding the audio signal to obtain a pulse amplitude modulation (PAM) signal and information about a sampling frequency of the PAM signal. The obtaining the scale of the first octave may include converting the PAM signal into a frequency-domain signal and apply the filter bank to the frequency-domain signal.

The obtaining the scale of the first octave may include filtering a frequency band corresponding to each of a plurality of target scales by using a plurality of digital filters included in the filter bank.

The plurality of digital filters may be band pass filters having center frequencies that are set based on the sampling frequency and a plurality of frequencies corresponding to each scale of the first octave.

The plurality of digital filters may be band pass filters having the plurality of frequencies as the center frequencies in a normalized frequency domain, and each of the center frequencies may be reduced to half of the center frequencies when the sampling frequency is reduced to half of the sampling frequency.

The obtaining the scale of the second octave may include obtaining the scale of the second octave by applying the filter bank to the audio signal by half, and the method may further include obtaining a scale of a third octave that is lower than the second octave by applying the filter bank to the audio signal that is down-sampled by one fourth.

The second octave may be an octave lower than the first octave by one octave, and the third octave may be an octave lower than the second octave by one octave.

The first octave may be a highest octave of a plurality of target octaves, and the audio signal may be a signal sampled at two times the highest frequency of the first octave or higher.

The electronic apparatus may include a plurality of light emitting elements, and the method may further include controlling an illuminating state of the plurality of light emitting elements based on at least one of the first octave and the second octave. The controlling may include controlling at least one of an illumination time of the light emitting elements, and a number and an intensity of illuminations of the light emitting elements corresponding to the scale of the at least one of the first octave and the second octave.

According to an aspect of another exemplary embodiment, there is provided a non-transitory computer readable storage medium storing a program that is executable by a computer to perform a method for controlling an electronic apparatus, wherein the method may include: obtaining a scale of a first octave by applying a filter bank to an audio signal based on a sampling frequency of an received audio signal; down-sampling the audio signal, and obtaining a scale of a second octave that is lower than the first octave by applying the filter bank to the down-sampled signal.

According to an aspect of another exemplary embodiment, there is provided an electronic apparatus, comprising: an input interface configured to receive an audio signal; a processor including: at least one down-sampler configured to down-sample the audio signal; a filter bank configured to apply a first set of digital band pass filters to the audio signal received by the input interface to obtain scales of a first octave, and configured to apply a second set of digital band pass filters to the down-sampled audio signal to obtain scales of a second octave, wherein center frequencies of the first set of digital band pass filters may be different from center frequencies of the second set of digital band pass filters, and the scales of the first octave may have higher frequencies than the scales of the second octave.

The at least one down-sampler may down-sample the audio signal a number of times, and the number of times may be set based on an frequency interval between the first octave and a target octave that is to be obtained from the down-sampled audio signal.

The at least one down-sampler may be further configure to down-sample a frequency of the audio signal by half.

According to various exemplary, it may be possible to reduce the number of computations and obtain a scale in a wider frequency band than the FFT-based method used in conventional scale detection.

BRIEF DESCRIPTION OF THE DRAWINGS

The above and/or other aspects will be more apparent by describing certain exemplary embodiments, with reference to the accompanying drawings, in which:

FIGS. 4A and 4B are views provided to explain the standard frequency for each of the octaves and scales to help understand exemplary embodiments;

DETAILED DESCRIPTION

Example embodiments will be described in detail with reference to the accompanying drawings. However, the scope of the present disclosure is not limited to the example embodiments. Instead, the example embodiments may be variously modified. While describing example embodiments, if the specific description regarding a known technology obscures the gist of the disclosure, the specific description is omitted.

In example embodiments, relational terms such as first and second, and the like, may be used to distinguish one entity from another entity, without necessarily implying any actual relationship or order between such entities.

The terms used herein are solely intended to explain a specific example embodiment, and not to limit the scope of the present disclosure. It is to be understood that the singular forms "a," "an," and "the" include plural referents unless the context clearly dictates otherwise. The terms "include," "comprise," "is configured to," etc., of the description are used to indicate that there are features, numbers, steps, operations, elements, parts or combination thereof, and they should not exclude the possibilities of combination or addition of one or more features, numbers, steps, operations, elements, parts or a combination thereof. The expression, "at least one of a and b," should be understood as including only a, only b, or both a and b.

In the example embodiments disclosed herein, a term "module" or "unit" refers to an element that performs at least one function or operation. The "module" or "unit" may be realized as hardware, software, or combinations thereof. In addition, a plurality of "modules" or a plurality of "units" may be integrated into at least one module and may be realized as at least one processor except for "modules" or "units" that should be realized in a specific hardware.

Figure 1:
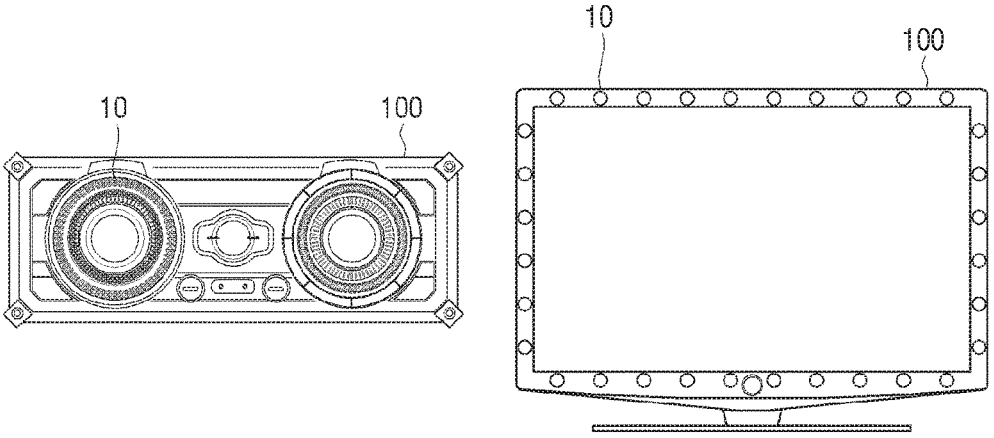
FIG. 1 is a view provided to explain an electronic apparatus according to an exemplary embodiment.

FIG. 1 is a view provided to explain an electronic apparatus according to an exemplary embodiment.

The electronic apparatus 100 may output au audio signal and provide a lighting effect according to the outputted audio signal. For example, the electronic apparatus 100 may be implemented as a speaker device, and/or a display device such as a TV including a plurality of light emitting elements, but may not be limited thereto.

Accordingly, the electronic apparatus 100 may be implemented as a variety of devices, such as a wireless speaker, a sound bar, a smart phone, a tablet, a PC, a large format display (LFD), a digital signage, a digital information display (DID), a video wall, a projector display, and so on.

As illustrated, the electronic apparatus 100 includes a plurality of light emitting elements 10, and may illuminate at least one of the plurality of light emitting elements according to an outputted audio signal to provide a lighting effect. The 'lighting effect' as used herein refers to provision of a feedback by illuminating a light emitting element corresponding to a frequency level (e.g., scale) of a currently-outputted audio signal. For example, the electronic apparatus 100 may map a plurality of light emitting elements to respective scales, octaves, scales of the octaves, and so on, and when the corresponding scale (or corresponding octave) is included in the outputted audio signals, may illuminate the corresponding light emitting element.

However, the electronic apparatus 100 is not limited to the example described above. For example, the electronic apparatus 100 may not be provided with a light emitting element, and the electronic apparatus 100 may perform communication with an external device having a plurality of light emitting elements. In this case, the electronic apparatus 100 may be configured to analyze the scale of the outputted audio signal, and control the illuminating state of the light emitting elements provided in the external device according to the obtained scale information, or transmit the obtained scale information to the external device.

Meanwhile, the electronic apparatus 100 according to an exemplary embodiment may obtain or detect scales of each of a plurality of octaves by using a digital filter, which will be described below with reference to various embodiments of the present disclosure and the drawings.

Figure 2A:
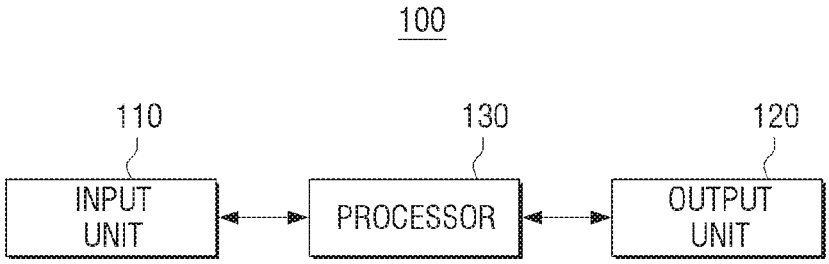
FIGS. 2A and 2B are block diagrams illustrating the configuration of an electronic apparatus according to an exemplary embodiment.

FIG. 2A is a block diagram illustrating the configuration of an electronic apparatus according to an exemplary embodiment.

According to FIG. 2A, an electronic apparatus 100 includes an input unit 110, an output unit 120, and a processor 130. The input unit 100 and the output unit 120 may be also referred to as an input interface and an output interface, respectively.

The input unit 110 receives an audio signal as an input. For example, the input unit 110 may receive an audio signal from an external device, an external server, and so on, via a communication method that uses an access point (AP)-based Wi-Fi, Bluetooth, Zigbee, wired/wireless local area network (LAN), a wide area network (WAN), Ethernet, IEEE 1394, high-definition multimedia interface (HDMI), universal serial bus (USB), and so on. Also, the input unit 110 may be a microphone that receives a voice or audio signal.

In this example, the audio signal may be a digital audio signal. A digital audio signal is a data signal of an analog signal, and this data should use a certain 'transmission format' according to the communication protocol.

For example, the digital audio signal may be in a signal form in which an analog audio signal is modulated according to a pulse code modulation (PCM) method. PCM is a method of converting an analog signal having temporal continuity into a temporally discrete signal. Specifically, PCM refers to a method of sampling an analog signal to generate a pulse amplitude modulation (PAM) signal, quantizing the sampled value (amplitude) of the PAM signal, that is, discrete signal, and encoding the signal into a binary or M-ary bit string (digital signal). That is, the transmitting side samples the analog audio signal to convert it into a PAM signal, and quantizes each sampled pulse of the PAM signal to encode it, and transmits the PCM signal. Accordingly, the electronic apparatus 100 decodes the received audio signal (i.e., the PCM signal) to convert it into a PAM signal and interpolates it with a filter to obtain the original input signal.

Meanwhile, as described above, the input digital audio signal may be a signal sampled at a predetermined sampling frequency. The 'sampling frequency' (hertz (Hz)) refers to the number of representative values of the signals sampled in one second from the original analog signal. That is, if the frequency of the sampling is 10 times per second, the sampling frequency is expressed as 10 Hz, and if the frequency of sampling is 100 times per second, the sampling frequency is expressed as 100 Hz.

Figure 3:
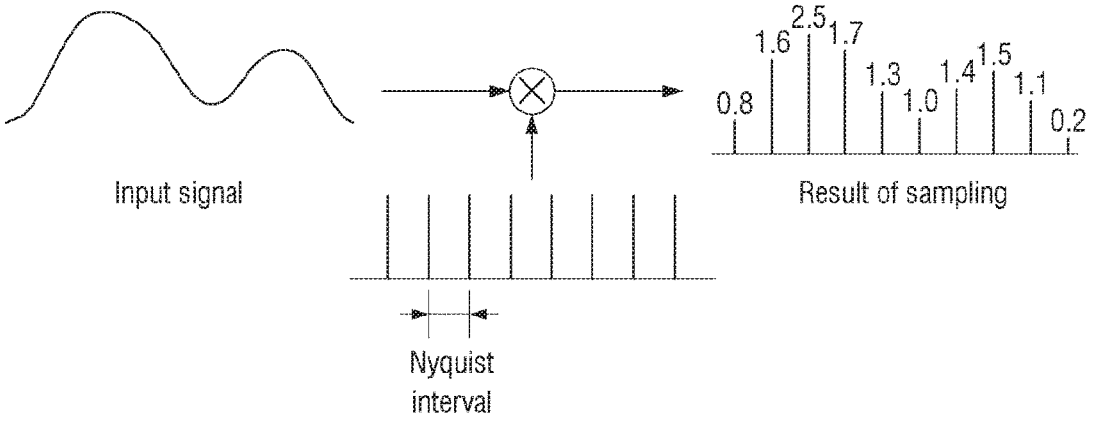
FIG. 3 is a view provided to explain a sampling method to help understand exemplary embodiments.

For example, the digital audio signal may be a signal sampled at a frequency that is two times the highest frequency included in the analog audio signal or higher, according to the sampling theory (or the Nyquist theory). That is, as shown in FIG. 3, the signal may be a signal sampled based on a Nyquist interval (or a sampling time interval).

For example, when it is assumed that the human's maximum audio frequency response is 20 kHz, the signal may be a signal that is sampled at frequency two times 20 kHz or higher. For example, the signal may be a signal sampled at 44.1 kHz, 48 kHz, and so on. In this example, 44.1 kHz is two times the 20 kHz including 10% error, and it is the standard sample rate of compact disc (CD) digital audio. 48 kHz is adopted in a digital versatile disc (DVD) format to maximize sound quality from that of 44.1 kHz, and when a signal is sampled at 48 kHz, this means that 48,000 samples are extracted in 1 second from analog audio signal. Of course, exemplary embodiments are not limited to the examples given above, and accordingly, various sampling frequencies such as 32 kHz, 38 kHz, 44.1 kHz, 88.2 kHz, 96 kHz, 192 kHz and so on may be used depending on the applications. Hereinafter, for convenience of explanation, it is assumed that the digital audio signal is a signal sampled at 48 kHz.

The output unit 140 may output an audio signal.

Specifically, the output unit 140 may convert the digital signal processed at the processor 130 into an analog signal, and amplify and output the same. For example, the output unit 140 may include at least one speaker unit, a digital/analog (D/A) converter, an audio amplifier, etc., capable of outputting at least one channel. For example, the output unit 150 may include a left (L) channel speaker, a center (C) channel speaker, and a right R channel speaker that may reproduce the L channel, the C channel, and the R channel, respectively. However, the present exemplary embodiment is not limited thereto, and the output unit 140 may be implemented in various forms. As another example, the output unit 140 may also be implemented in a sound bar form that reproduces the L channel, the R channel, and the C channel.

The filter bank may filter a frequency band that corresponds to each of at least one target scale. In this example, the filter bank may be implemented as a digital signal processor (DSP) or a multiplier large-scale integration (LSI) chip. However, in some cases, the filter bank may be implemented as a central processing unit (CPU). The filter bank may be implemented as a processor 130 described below, although it is depicted as a separate component for convenience of explanation.

In particular, the filter bank includes a plurality of digital filters corresponding to the number of target scales in one octave. In this example, each of the plurality of digital filters may be implemented as a band pass filter that filters only a specific frequency.

Specifically, the plurality of digital filters may be implemented as a band pass filter. The center frequency, the low cut-off frequency, and the high cut-off frequency of the band pass filter may be set based on pitch information that corresponds to a predetermined sampling frequency and each of scales of a predetermined octave. The 'pitch' may represent a musical tone that is determined by the frequency of the waves that produce the sound. Sounds may be higher or lower in pitch according to the frequency of vibration of the sound waves. The pitch information may contain information of the frequency of each scale. In particular, the center frequency of the plurality of digital filters may be the pitch information (that is, the frequency value) of each scale, and the bandwidth of the band pass filter may be set within a predetermined threshold range based on the center frequency. In addition, the predetermined sampling frequency may be a sampling frequency of the received audio signal, which may be 48 kHz for example, and the predetermined octave may be the highest octave of the target octaves.

In particular, the plurality of digital filters may be implemented as a band pass filter having a center frequency respectively corresponding to a plurality of pitches in the normalized frequency domain. In this case, each of the digital filters may have a form in which each of the center frequencies is linearly scaled down to ½ when the sampling frequency is reduced to ½.

According to an exemplary embodiment, each of the plurality of digital filters may filter a plurality of scales (e.g., twelve scales) within one octave, respectively.

FIG. 4B is a view provided to explain the standard frequency for each of the octaves and scales to help understand exemplary embodiments.

The term 'scale' may refer to a staircase of sounds in which sounds are arranged in order of height, or a graduated series of musical tones ascending or descending in order of pitch. The term 'octave' may refer to an interval between one pitch and another pitch that has a frequency that is two times as high as the other pitch, or an interval between two frequencies having a ratio of 2 to 1. The scale may be repeated for every octave. For example, one octave can be divided into twelve scales (or chromatic scale). However, the present exemplary embodiment is not limited thereto, and the number of scales in one octave may vary based on the form into which the octave is divided. However, for convenience of explanation, it is assumed that twelve scales are provided in one octave.

As shown in FIG. 4A, according to the standard frequency for each octave and scale, the scales adjacent to each other have 2^(1/12) times higher frequency. For example, a signal having a scale "A4 (La)" has a frequency of 440 Hz, and a signal having one scale difference with reference to the signal has 2^(1/12) times higher frequency.

That is, when the octave consists of twelve scales and has the frequency characteristics as shown in FIG. 4B, the scale that is one octave higher, i.e., the scale that is twelve scales higher has 2^(12/12) times higher frequency. That is, the signal of scale "A#4(La#)" that is one octave higher with reference to 440 Hz which is the signal of scale "A4(La)" is 466.2 Hz, that is 2^(1/12) times higher, and signal "G#4 (Sol#)" that is one octave lower has a frequency of 415.3 Hz which is 2^(−1/12) times higher. The signal "A5 (La)", which is one octave higher than the signal "A4 (La)", has a frequency of 880 Hz that is two times higher, and the signal "A3 (La)", which is one octave lower than the signal "A4 (La)", has a frequency of 220 Hz that is half. As described above, there is the characteristic that each time the scale is lowered by one octave, the frequency is lowered to ½.

It may be possible to obtain the same scale from different octave regions using one digital filter based on the frequency characteristics of the octave as described above and the relationship between the sampling frequency of the audio signal and the cutoff frequency of the digital filter. For example, the same scale may be obtained from different octave regions using a digital filter defined in the normalized frequency domain, i.e., in $-\pi$ to $\pi$ (or 0 to $2\pi$) region. That is, each of the plurality of digital filters may be implemented to be linearly scaled according to the sampling frequency of the input signal to obtain each scale from different octaves.

For example, when a digital filter having a cutoff frequency of $\pi/2$ radians (¼ (=0.25) of the sampling frequency) in the normalized frequency domain is applied to an input signal sampled at 48 kHz, the digital filter will operate as a filter having a center frequency at 12 kHz.

In addition, when the same digital filter is applied to a signal down-sampled by ½, i.e., to a signal sampled at 24 kHz, the digital filter having a cutoff frequency of $\pi/2$ radian will have a center frequency at 6 kHz.

Accordingly, for the sampling frequencies of 12 kHz and 6 kHz, the center frequency of the digital filter becomes 3 kHz and 1.5 kHz, and so on, such that the same filtering can be performed with one single filter by repeating the above for each of the frequencies corresponding to (½)^n frequency.

The processor 130 controls the overall operation of electronic apparatus 100. The processor 130 may include one or more of a central processing unit (CPU), a micro controller unit (MCU) controller, an application processor (AP), or a communication processor (CP), or an ARM processor, or may be defined in that term. In addition, the processor 130 may be implemented as a digital signal processor (DSP), or implemented as a SoC in which a content processing algorithm is embedded, or implemented as a field programmable gate array (FPGA).

According to an exemplary embodiment, when the processor 130 is implemented as a DSP, the processor 130 may be implemented so as to also perform the functions of the filter bank. According to another exemplary embodiment, the processor 130 may be implemented as a CPU, and the filter bank may be implemented as a DSP. According to yet another exemplary embodiment, it may be possible that both the filter bank and the processor 130 may be implemented as a CPU.

The processor 130 may process the received audio signal to convert it into a form suitable for applying the filter bank. In this example, the received audio signal may be a time-domain signal, or more specifically, it may be a signal sampled in the time domain.

The processor 130 may convert the time-domain signal into a frequency-domain signal and apply a filter bank to the frequency-domain signal. For example, the processor 130 may decode a received audio signal (i.e., a PCM signal) to acquire a PAM signal and convert it into a frequency-domain signal.

Meanwhile, the received audio signal may be a signal that is compressed according to the audio compression standard, and the compressed signal may include additional information on the audio signal, such as the information on the sampling frequency (sampling rate) in particular. For example, when the received audio signal is compressed according to MPEG 2 or MPEG 4 standard, the signal may be in the form of an MPEG 2 or MPEG 4 transport stream, and the corresponding information may be included in the header of the transport packet constituting the transport stream. However, various other compression standards may be applied for the compression and transmission of an audio signal.

In particular, the processor 130 may decode the compressed signal to acquire both the PCM signal and the information on the sampling frequency at the same time.

The processor 130 may apply the filter bank to the frequency-domain signal to obtain the scale of the first octave.

In addition, the processor 130 may down-sample the audio signal and apply the filter bank to the down-sampled signal, respectively, to obtain the second octave scale lower than the first octave. Specifically, the processor 130 may down-sample the PAM signal and then convert it into a frequency-domain signal and apply the filter bank.

Specifically, the processor 130 may apply a plurality of digital filters to an received audio signal sampled at a predetermined frequency to obtain a scale of the first octave, and apply a plurality of digital filters to the received audio signal that is ½ down-sampled, respectively, to obtain the scale of the second octave that is lower than the first octave by one octave.

In this example, by the '½ down-sampling', it means that only the samples of two intervals are remained in the received audio signal sampled at the predetermined frequency. In particular, after applying an anti-aliasing low-pass filter (LPF) to the received audio signal, only samples at two intervals are left in the sampled signal. The anti-aliasing LPF may be applied to attenuate frequencies higher than the Nyquist frequency to prevent aliasing components from being collected. In addition, the processor 130 may apply a plurality of digital filters to the ¼ down-sampled signal of the received audio signal, respectively, to obtain a scale of a third octave that is lower than the second octave by one octave. In this example, by the '¼ down-sampling', it means that only the samples at four intervals are left in the received audio signal sampled at the predetermined frequency. Alternatively, it means that only the samples at two intervals are left in the ½ down-sampled signal. In this case, it is of course possible that the anti-aliasing LPF can be applied.

For example, it is assumed that the received audio signal is sampled at 48 kHz, and the highest octave is the seventh octave, i.e., at 2093 to 3951 Hz, based on the table shown in FIG. 4A.

In this case, by the sampling theory, since the maximum frequency of the sampled data, i.e., the received audio signal, is 24 kHz, the center frequency of the digital filter corresponding to each of the scales may be: 2093.005 Hz, 2217.461 Hz, 2349.318 Hz, 2489.016 Hz, 2637.020 Hz, 2793.826 Hz, 2959.955 Hz, 3135.963 Hz, 3322.438 Hz, 3520.000 Hz, 3729.310 Hz, 3951.066 Hz, based on the table shown in FIG. 4A.

Figure 5A:
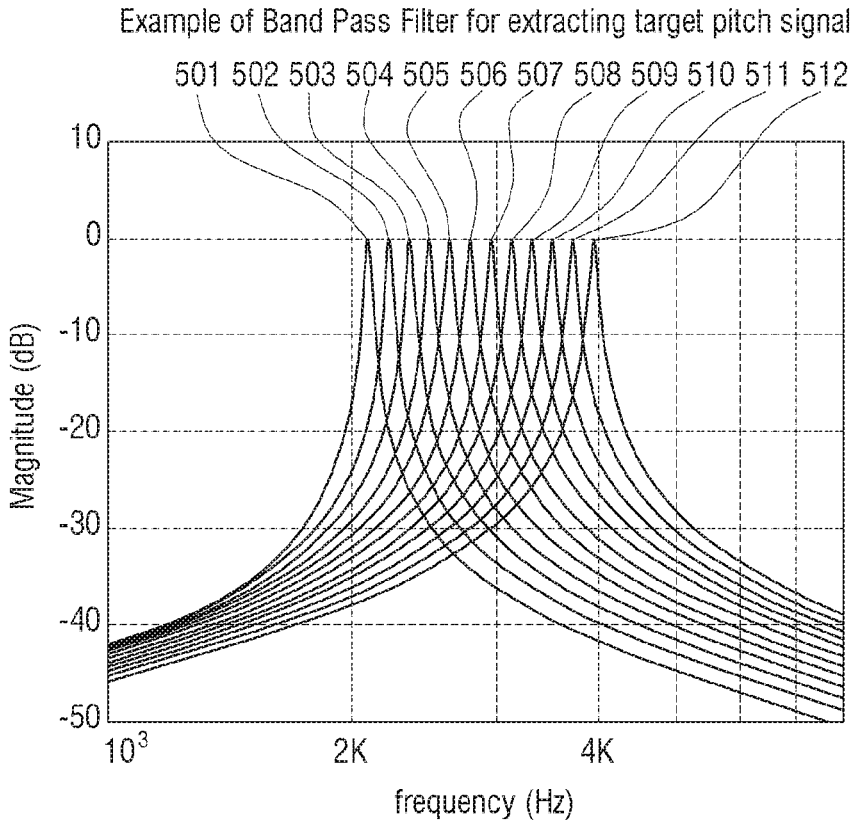
FIGS. 5A, 5B, 6A and 6B are views provided to explain a digital filter according to an exemplary embodiment.

A plurality of digital filters 501 to 512 as shown in FIG. 5A may be provided based on the frequencies of the respective scales.

The position of the center frequency of the digital filter may be determined to be: 2093.005/24000 (C (Do)), 2217.461/24000 (C#), 2349.318/24000 (D (Re)), 2489.016/24000 (D#), 2637.020/24000 (E (Mi)), 2793.826/24000 F (Fa)), 2959.955/24000 (F#), 3135.963/24000 (G (Sol)), 3322.438/24000 (G#), 3520.000/24000 (A (Ra)), 3729.310/24000 (A#), 3951.066/24000 (B (Si)).

That is, the center frequency of the digital filter corresponding to each of the scales has a magnitude of, such as, approximately 0.0872083, 0.09239420, 0.09788825, 0.103709, 0.10987583, 0.1164094, 0.1233331, 0.1306651, 0.138434917, 0.1466666, 0.15538792, 0.16462775 of the maximum frequency. The center frequency of the digital filter thus calculated may be a normalized frequency of each of the plurality of digital filters. That is, in the normalized digital domain, it has the cutoff frequencies at positions of 0.0872083, 0.09239420, 0/09788825, 0.103709, 0.10987583, 0.1164094, 0.1233331, 0.1306651, 0.138434917, 0.1466666, 0.15538792, 0.16462775 of the sampling frequency.

Figure 5B:
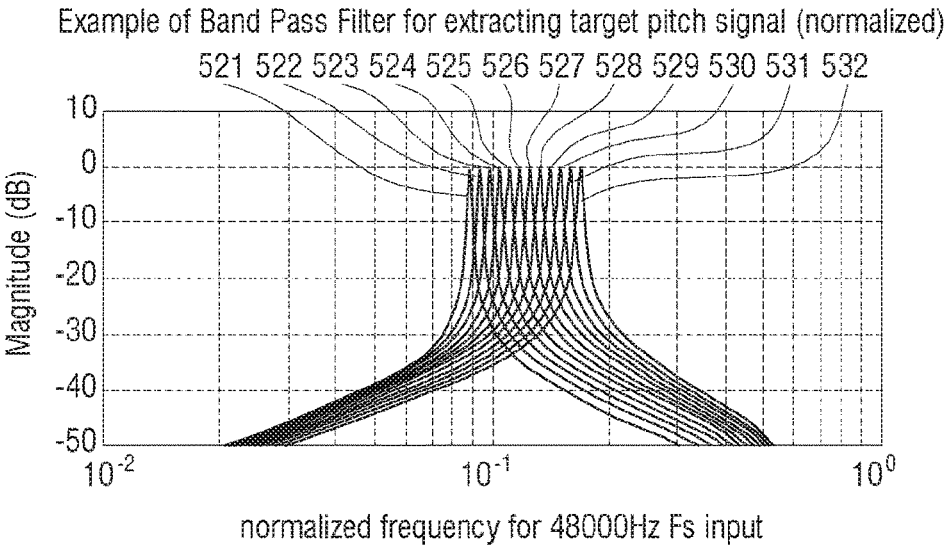

Accordingly, the plurality of normalized digital filters 521 to 532 applied to the audio signal sampled at 48 kHz may be in the form as shown in FIG. 5B.

Figure 6A:
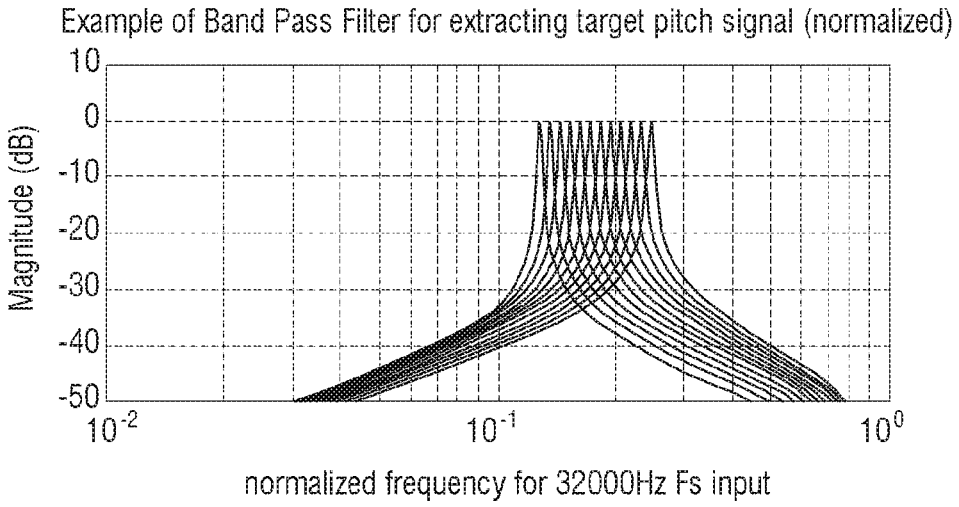
Figure 6B:
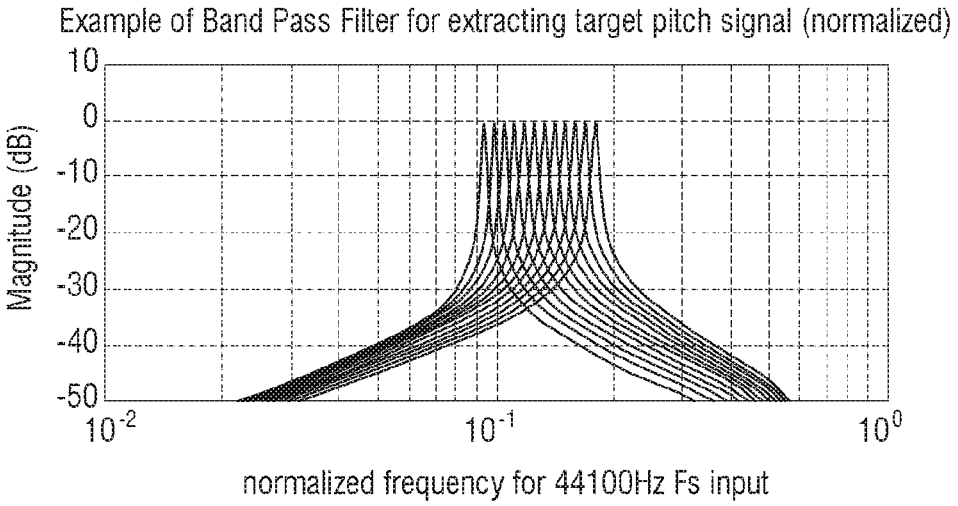

In the same manner, a plurality of normalized digital filters applied to an audio signal sampled at 32 kHz and 44.1 kHz may be in the form as shown in FIGS. 6A and 6B, respectively. Meanwhile, the processor 130 may apply a plurality of digital filters 521 to 523, each having a center frequency corresponding to each of the scales as described above, to audio signals sampled at 48 kHz, respectively, to obtain the twelve scales of the maximum octave, i.e., the scales at 2093 to 3951 Hz (i.e., seventh octave), respectively. In this example, it is assumed that eighth octave is excluded.

The processor 130 then down-samples the audio signal sampled at 48 kHz to ½ and applies each of the plurality of digital filters to the down-sampled signal to obtain the twelve scales of the next highest octave, i.e., the scales at 1046 to 1975 Hz (i.e., sixth octave), respectively. That is, when the sampling frequency is halved (½), the center frequency of the digital filter is also halved (½). This is because, in an audio signal sampled at 48 kHz, it is possible to obtain a signal up to 24 kHz according to the sampling theory, and when the sampling frequency is halved (½), that is, in an audio signal sampled at 24 kHz, it is possible to obtain a signal up to 24 kHz according to the sampling theory. Accordingly, when a digital filter for filtering a relative position is applied to a signal sampled at different frequencies from each other, the frequency to be filtered is linearly scaled according to the sampling frequency.

For example, in the embodiment described above, since the normalized center frequencies of each of the plurality of digital filters are 0.0872083, 0.09239420, 0.09788825, 0.103709, 0.10987583, 0.1164094, 0.1233331, 0.1306651, 0.138434917, 0.1466666, 0.15538792, 0.16462775, respectively, when a plurality of digital filters are respectively applied to an audio signal down-sampled at 24 kHz, it is possible to obtain up to 12 kHz, and accordingly, the scale C (Do) may be obtained by 0.0872083*12000=1046.5, and the scale "C#" may be obtained by 0.09239420*12000=1108.73.

The processor 130 then down-samples the audio signal down-sampled at 24 kHz by ½ and applies each of the plurality of digital filters to the down-sampled signal to obtain the twelve scales of the next highest octave, i.e., the scales at 523 to 987 Hz (i.e., fifth octave), respectively. That is, when a plurality of digital filters are respectively applied to an audio signal down-sampled at 12 kHz, the scale "C (Do)" may be obtained by 0.0872083*6000=523.25 and the scale "C#" may be obtained by 0.09239420*6000=554.365.

In this way, the processor 130 may repeatedly down-sample the audio signal by ½ to obtain the scales corresponding to each of the octaves.

Specifically, the processor 130 may obtain the scales based on the magnitude of the pitch component in the filtered signal and the magnitude of the received audio signal, with a digital filter for obtaining specific scales.

Specifically, when a specific scale, that is, a specific frequency is included in the audio signal, the signal filtered by the corresponding filter should include a pitch component of a predetermined magnitude or greater. In this example, the predetermined magnitude may be determined by the magnitude (or amplitude) of the audio signal, the cutoff frequency of the band pass filter, the bandwidth, and so on. For example, if the frequency band to pass is so narrow that only the frequency of the corresponding scale is passed, the corresponding scale itself may be obtained by the pitch component itself.

Figure 7A:
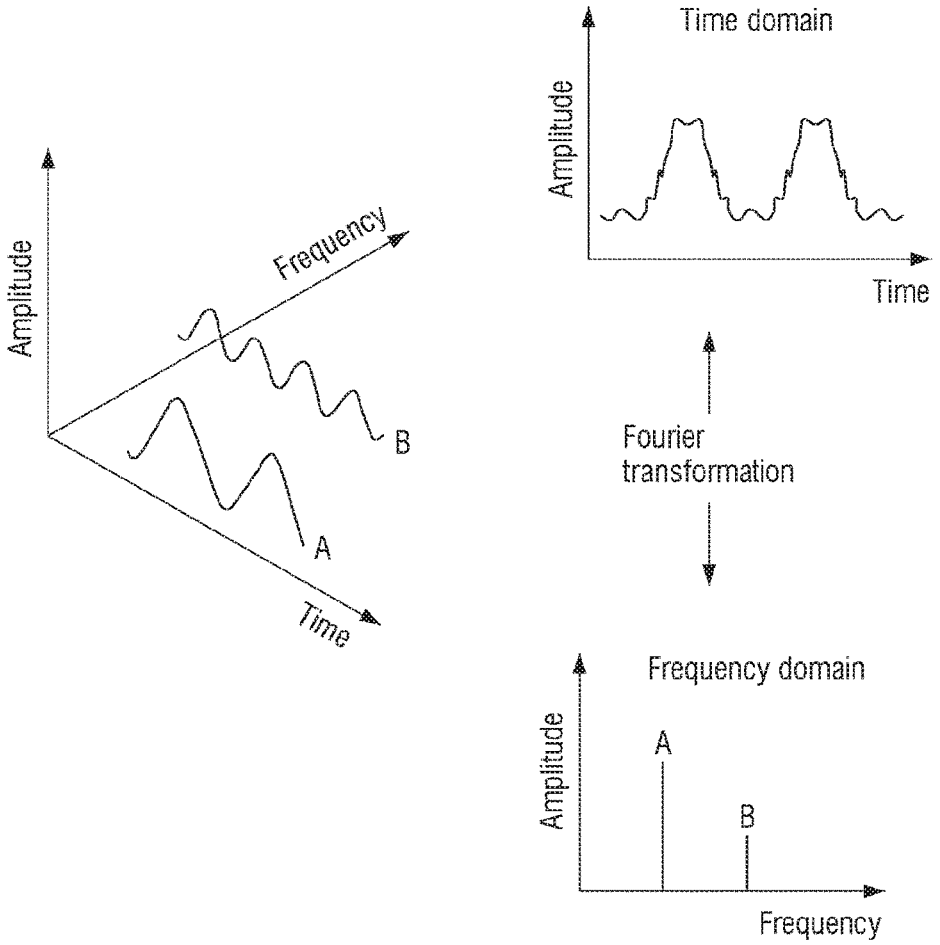
FIGS. 7A, 7B, and 7C illustrate graphs provided to explain a detailed operation of a processor according to an exemplary embodiment.

For example, as shown in FIG. 7A, an audio signal may be a synthetic waveform in which a plurality of signals A, B having different frequencies (or pitches) from each other are synthesized. Accordingly, converting this into frequency domain will result in a form such as that shown on the lower half of the right-hand side of the drawing, based on the pitch of the signal A and the pitch of the B signal.

Figure 7B:
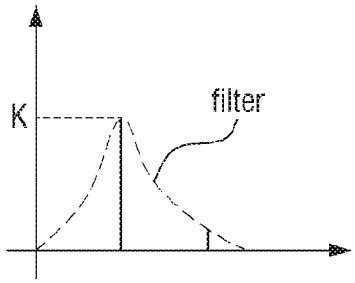
Figure 7C:
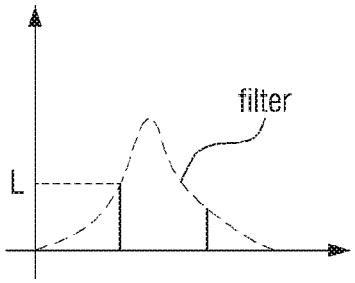

When a filter for filtering a specific scale is applied in such a frequency domain, if a signal corresponding to the corresponding scale is included in the audio signal, a pitch component of a predetermined magnitude K or greater is obtained, as shown in FIG. 7B. However, if a signal corresponding to the corresponding scale is not included in the audio signal, only a pitch component less than a predetermined magnitude L may be obtained, as shown in FIG. 7C.

Based on this, the processor 130 is able to obtain if the audio signal includes a specific scale.

The output unit 120 functions to output an audio signal.

Specifically, the output unit 120 may convert the digital signal processed at the processor 130 into an analog signal, and amplify and output the same. For example, the output unit 120 may include at least one speaker unit, a D/A converter, an audio amplifier, etc., capable of outputting at least one channel. For example, the output unit 120 may include an L channel speaker and an R channel speaker that can reproduce the L channel and the R channel, respectively. However, the present disclosure is not limited to the examples provided above, and accordingly, the output unit 120 may be implemented in various forms. As another example, the output unit 120 may also be implemented in a sound bar form that reproduces the L channel, the R channel, and the center channel.

Meanwhile, since the number of computations to be performed in the digital domain is reduced by the number of samples according to the down-sampling of the audio signal as described above, the number of computations of the processor can be reduced. That is, when the down-sampling by ½ is performed, the time-complexity is reduced to ½.

Meanwhile, in the embodiment described above, the audio signal sampled at 48 kHz is sequentially down-sampled by ½ each time, but this is merely an example. According to another embodiment, it is of course possible that twelve scales of seventh octave may be obtained based on the received audio signal sampled at 48 kHz, and the received audio signal sampled at 48 kHz may be down-sampled to ½ to obtain twelve scales of sixth octave, and the received audio signal sampled at 48 kHz may be down-sampled to ¼ to obtain twelve scales of fifth octave.

Meanwhile, according to another embodiment of the present disclosure, when the processor 130 obtains only the scales irrespective of the octaves, the processor 130 may obtain the scale values by merging the information of the same scales in each of the octave bands. For example, in order to obtain only the presence or absence of a C# scale regardless of the octave, it is also possible to obtain whether the scale is included or not based on a representative value of the magnitude of the C#, such as an average value, a maximum value, etc.

Figure 2B:
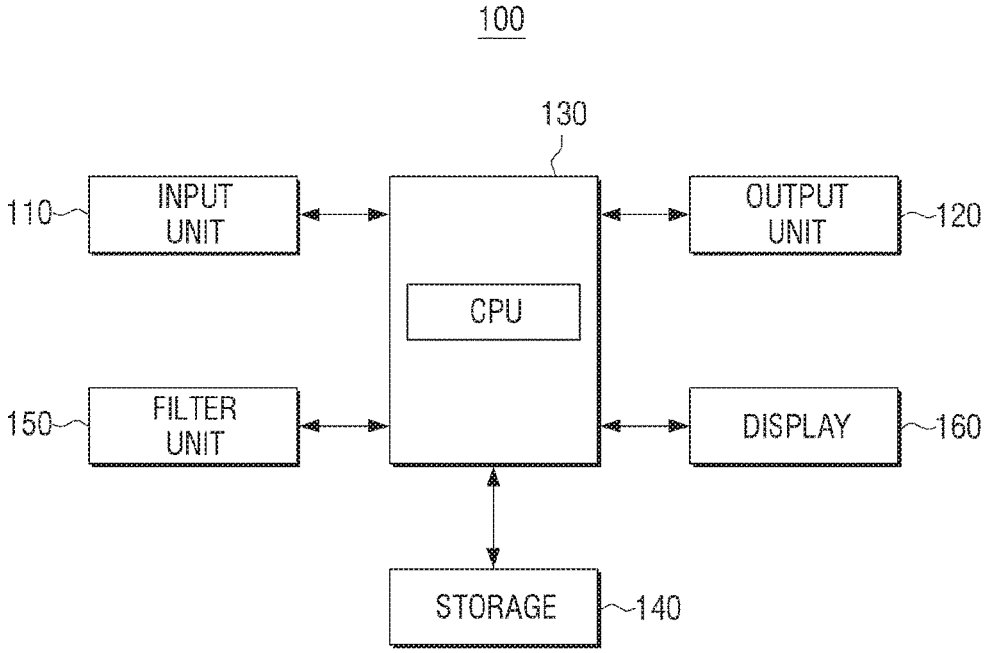

FIG. 2B is a block diagram illustrating the detailed configuration of the electronic apparatus shown in FIG. 2A.

According to FIG. 2B, the electronic apparatus 100 includes an input unit 110, an output unit 120, a processor 130, a filter bank 140, a storage 150, and a display 160. The detailed description of the configuration shown in FIG. 2B that is the same as the configuration shown in FIG. 2A will be omitted.

The processor 130 may include a CPU 131, a ROM (ROM or nonvolatile memory) storing a control program for controlling the electronic apparatus 100, and a RAM (RAM, or volatile memory) used as a storage area for storing data inputted from outside the electronic apparatus 100 and corresponding to various operations performed in the electronic apparatus 100.

The processor 130 may execute an Operating System (OS), a program, and various applications stored in the storage 150 when a predetermined event occurs. The processor 130 may include a single core, a dual core, a triple core, a quad core, and a multi-core.

The CPU 131 accesses the storage 150 to perform booting using the O/S stored in the storage 150. Then, various operations are performed using various programs, contents, data, and so on stored in the storage 150.

In addition, the processor 130 may include a digital signal processor (DSP), and the DSP may add various functions such as a digital filter, an effect, and an acoustic feel, etc., and an over-sampling technique for preventing deterioration of sound quality during conversion between analog and digital signals can also be applied.

The storage 150 may store various data, programs, or applications for driving/controlling the electronic apparatus 100. The storage 140 may store a control program for controlling the electronic apparatus 100 and the processor 130, applications, databases, or related data originally provided by a manufacturer or downloaded externally.

The storage 150 may be implemented as an internal memory such as a ROM or a RAM included in the processor 130 or may also be implemented as a separate memory from the processor 130. In this case, the storage 150 may be implemented in the form of a memory embedded in the electronic apparatus 100, or a removable memory in the electronic apparatus 100 depending on the purpose of storing data. For example, in the case of data for driving the electronic apparatus 100, the data may be stored in a memory embedded in the electronic apparatus 100, and in the case of data for the extended function of the electronic apparatus 100, such data may be stored in a removable memory in the electronic apparatus 100. Meanwhile, the memory embedded in the electronic apparatus 100 may be implemented in the form of a nonvolatile memory, a volatile memory, a hard disk drive (HDD), or a solid state drive (SSD), and the removable memory in the content output apparatus 200 may be implemented in the form such as a memory card (for example, a micro SD card, a USB memory and so on), an external memory (for example, a USB memory) connectable to a USB port, and so on.

The display 160 includes a plurality of light emitting elements and may provide light feedback according to the audio signal being outputted.

In this example, a plurality of light emitting elements may be provided in the outer housing of the electronic apparatus 100. For example, when the electronic apparatus 100 is implemented as a cylindrical speaker device, the plurality of light emitting elements may be arranged at predetermined intervals along the edge of the top circle of the electronic apparatus 100. Alternatively, a plurality of light emitting elements may be arranged at predetermined intervals along the edge of the side surface of the electronic apparatus 100. As another example, when the electronic apparatus 100 is implemented as a TV, a plurality of light emitting elements may be arranged at predetermined intervals along the bezel area of the TV. In this example, the plurality of light emitting elements may be implemented as LEDs, although the present disclosure is not limited thereto.

In some cases, a transparent sheet may be disposed on the plurality of LEDs so that the light of the plurality of LEDs is continuously displayed without a border. The plurality of LEDs may be implemented to have the same color or different colors. In addition, the plurality of LEDs may have different colors from each other depending on positions they are arranged. Further, in some cases, pairs of LEDs of different colors from each other may be arranged adjacent to each other.

Meanwhile, the processor 130 may match each of the scales to a plurality of LEDs such that, when a specific scale is obtained from the outputted audio signal, the processor 130 may illuminate the LED corresponding to the corresponding scale. For example, the first light emitting element may be matched to the C scale, and the second light emitting element may be matched to the D scale such that corresponding light emitting elements may be illuminated each time the scale is obtained.

In addition, the processor 130 may control the illuminating states of the plurality of LEDs by matching the same scales of different octaves with at least one of different frequency of illumination, and different time of illumination. For example, when the C scale of sixth octave is obtained, the first light emitting element may be briefly illuminated once, and when the C scale of seventh octave is obtained, the first light emitting element may be illuminated two times successively. As another example, when the C scale of sixth octave is obtained, the first light emitting element may be illuminated for two seconds, and when the C scale of seventh octave is obtained, the first light emitting element may be illuminated for four seconds.

According to another embodiment, the processor 130 may control an illuminating state of an external device by matching different octaves to a plurality of light emitting elements provided in at least one external device. For example, the first to seventh external devices matching the first to seventh octaves respectively may be controlled accordingly.

Figure 8A:
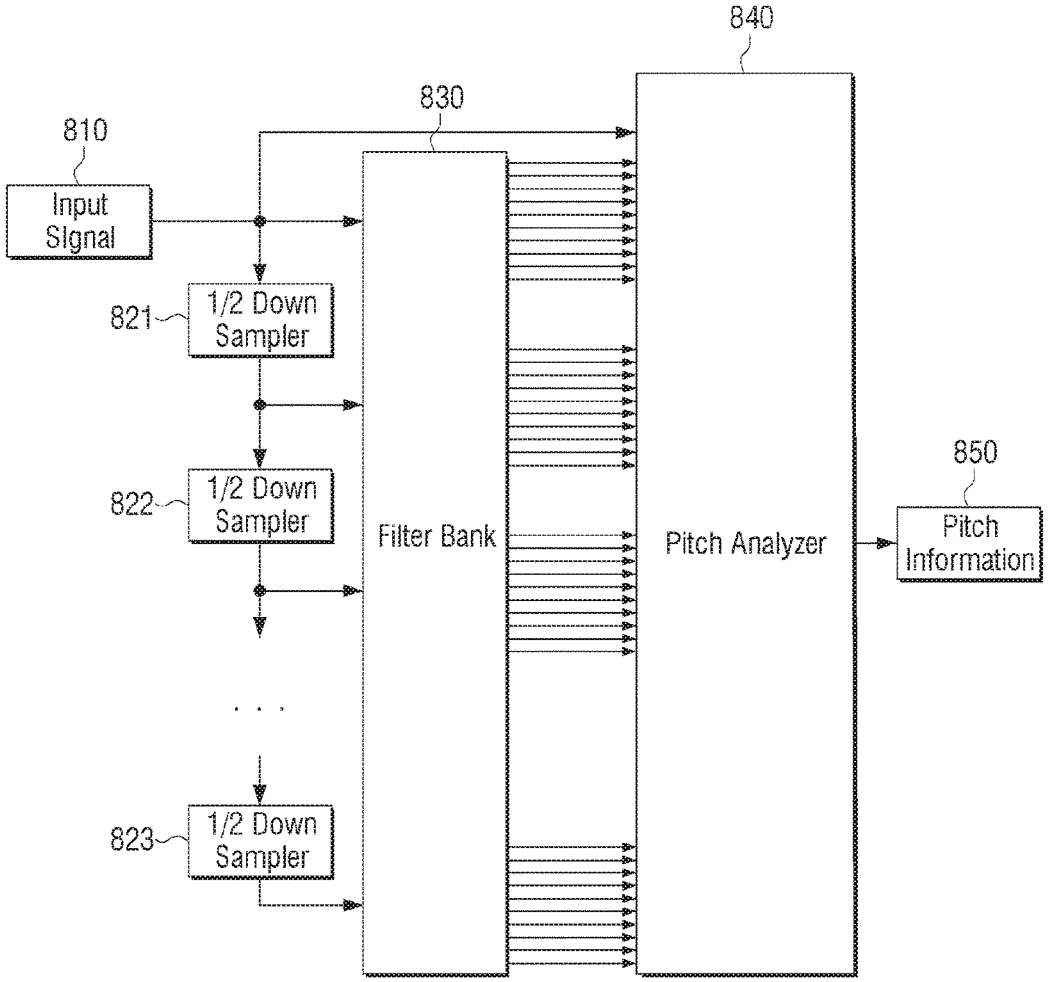
FIGS. 8A, 8B, and 8C illustrate block diagrams provided to explain a detailed operation of the processor according to an exemplary embodiment.
Figure 8B:
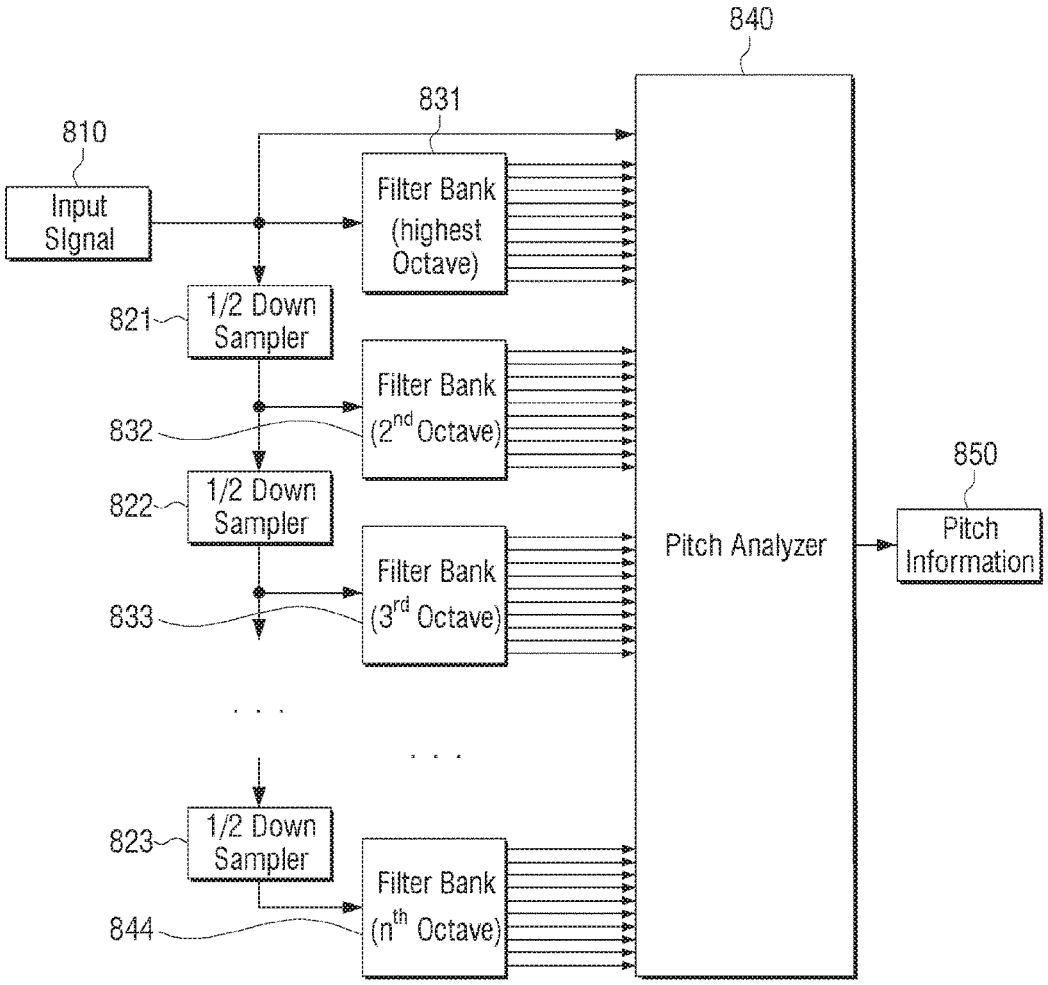

FIGS. 8A and 8B are block diagrams provided to explain the detailed operation of a processor according to an exemplary embodiment.

As shown in FIG. 8A, a processor 130 may include a plurality of half down samplers 821-823, a filter bank 830, and a pitch analyzer 840. The processor 130 may receive an input audio signal 810. The audio signal 810 may be a time-domain signal, and the processor 130 may convert the time-domain signal into a frequency-domain signal and provide the frequency-domain signal to the filter bank 830. The frequency-domain signal provided to the filter bank 830 may be a signal of a predetermined time unit that is converted into a frequency-domain signal. That is, the processor 130 may obtain whether or not the scales are included in the audio signal 810 based on a predetermined time unit.

The processor 130 may obtain information on the sampling frequency in the process of decoding the inputted compression audio signal, and may apply a specific filter bank 830 based on the corresponding sampling frequency.

The processor 130 may apply the filter bank 830 to the frequency-domain signal to filter the scale of the highest octave of the target octaves.

Figure 8C:
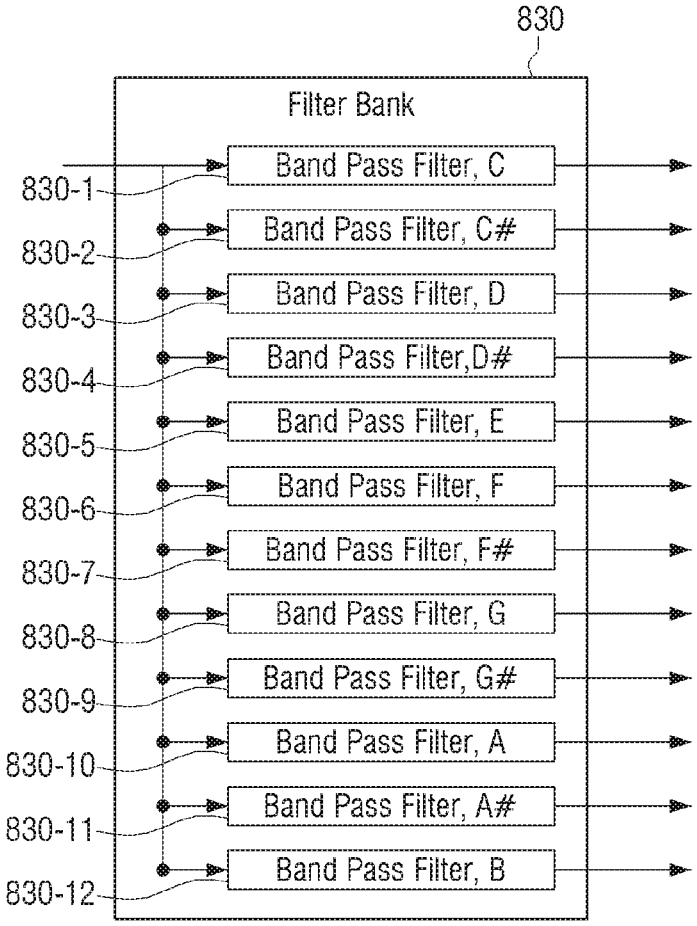

In this case, the filter bank 830 may include, for example, a plurality of digital filters 830-1 to 830-12 for respectively obtaining twelve scales as shown in FIG. 8C, and may apply the plurality of digital filters 830-1 to 830-12 to the audio signal 810, respectively. In this example, the plurality of digital filters 830-1 to 830-12 may be implemented as a band pass filter for filtering a frequency signal in the frequency domain.

The pitch analyzer 840 may analyze the pitch of the filtered signal passed through the filter bank 830 to obtain pitch information 850 that includes the scales in the first octave. Specifically, the scale included in the audio signal may be obtained by analyzing the magnitude of the received audio signal and the magnitude of the filtered signal.

In addition, the half down sampler 821 may down-sample the input signal 810 by ½ sampling frequency and provide the down-sampled input signal 810 to the filter bank 830. The filter bank 830 may filter each of the scales of the second octave that is one octave lower than the first octave.

The pitch analyzer 840 may analyze the pitch of the filtered signal to obtain pitch information 850 that includes the scales in the second octave.

Also, the audio signal down-sampled by ½ is down-sampled by the half down sampler 822 by ½ and provided to the filter bank 830, and the filter bank 830 may filter each of the scales of the third octave of the third octave that is one octave lower than the second octave.

The analyzer 840 may analyze the pitch of the filtered signal passed through the filter bank 830 to obtain pitch information 850 that includes the scales in the third octave.

By repeating this process, the scales of the entire octaves may be obtained with the same filter bank 830.

Meanwhile, in the process described above, the filter bank 830 may be implemented as the filter bank 140 of FIG. 2B, and the sampling process, the pitch analysis process, and the scale detection process may be performed at the processor 130 of FIG. 2A.

In FIG. 8A, a plurality of half down samplers 821-823 are provided in the processor 130, but the present exemplary embodiment is not limited thereto. For example, the processor 130 may include a single half down sampler 821, and the half down sampler 821 may perform the down-sampling a certain number of times according to a corresponding octave. The half down sampler 821 may have a loop structure to repeat the down-sampling. For example, the half down-sampler 821 may perform the down-sampling once in order to obtain the scales in a second octave through the filter bank 830 and the pitch analyzer 840. The down-sampled signal may be inputted to the half down-sampler 821 so that the half down-sampler 821 may perform the down-sampling again on the already down-sampled signal in order to obtain the scales in a third octave through the first bank 830 and the pitch analyzer 840.

Meanwhile, to help understand of the present disclosure, FIG. 8C shows that the filter bank 830 is implemented as a plurality of filter banks 831, 832, 833, and so on for obtaining each of the scales within a plurality of octaves. However, in an exemplary embodiment, the plurality of filter banks 831, 832, 833, and so on may eventually be implemented as the same filter bank, since the same filter bank is used for the detection of the scales of different octaves from each other.

Figure 9:
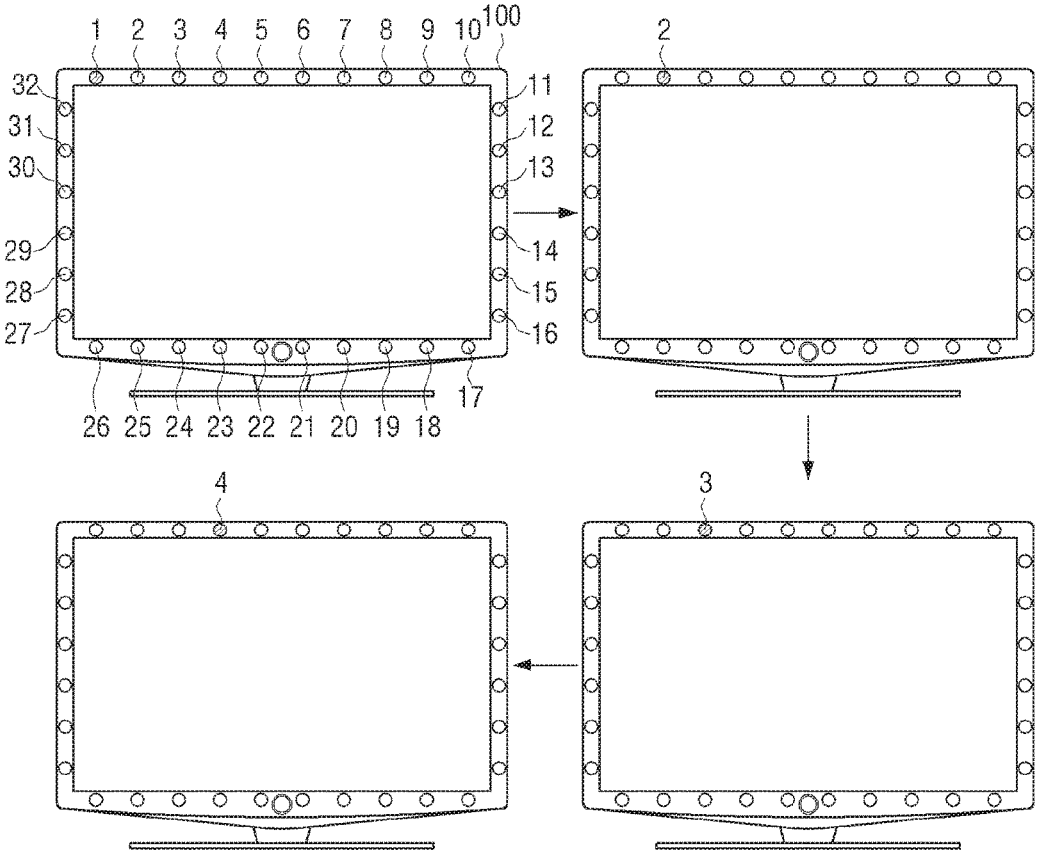
FIG. 9 is a view provided to explain a method of providing a light feedback according to an exemplary embodiment.

FIG. 9 is a view provided to explain a method of providing a light feedback according to an exemplary embodiment.

Meanwhile, according to FIG. 9, the electronic apparatus 100 may be implemented as a TV, and the plurality of light emitting elements 1 to 32 may be arranged at predetermined intervals along the bezel area of the TV. In this example, the plurality of light emitting elements may be implemented as LEDs, but the present disclosure is not limited thereto.

In this case, each LED is matched with at least one scale of at least one octave, and when the corresponding scale is obtained from the outputted audio signal, the corresponding light emitting element may be illuminated.

For example, if the first LED 1, the second LED 2, the third LED 3 and the fourth LED 4 are matched to the C, C#, D, D# scales of a particular octave, respectively, when a corresponding scale is sequentially obtained from an outputted audio signal, the first LED 1, the second LED 2, the third LED 3 and the fourth LED 4 may sequentially be illuminated for a predetermined time as shown in the drawing.

It is assumed that the first LED 1, the second LED 2, the third LED 3 and the fourth LED 4 are matched to the C, C#, D, D# scales of the first to fourth octaves, respectively. In this case, when the first to fourth octaves are matched with different illumination times, such as first to fourth times for example, the first LED 1, the second LED 2, the third LEDs 3 and the fourth LED 4 may sequentially be illuminated for the first to fourth times, respectively.

Figure 10:
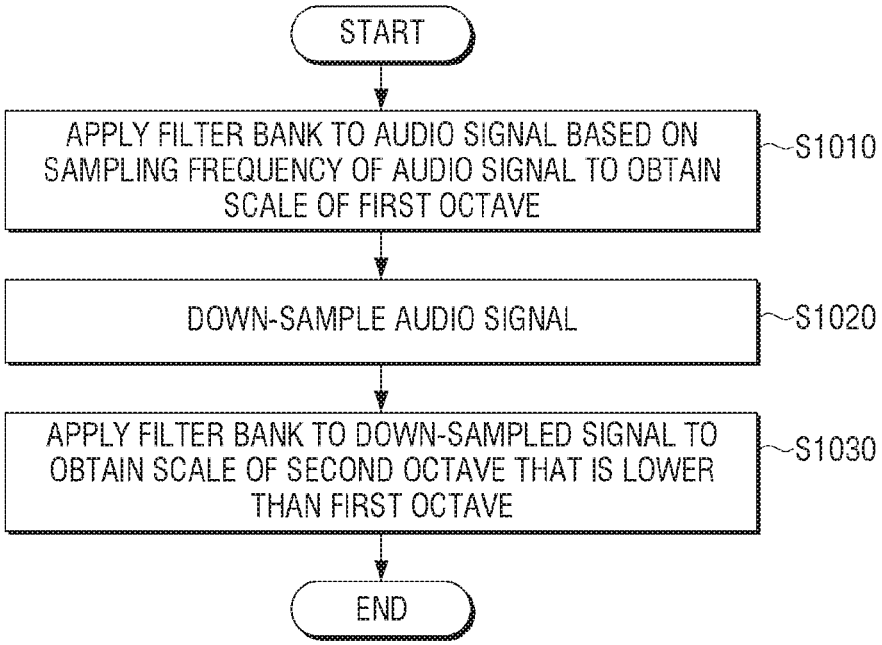
FIG. 10 is a flowchart provided to explain a control method of an electronic apparatus according to an exemplary embodiment.

FIG. 10 is a flowchart provided to explain a control method of an electronic apparatus according to an exemplary embodiment.

According to the control method of the electronic apparatus shown in FIG. 10, a predetermined filter bank is applied to the audio signal based on the sampling frequency of the received audio signal, to thus obtain the scale of the first octave, in operation S1010. In this example, the first octave may be the highest octave of the target octaves. In addition, the audio signal may be a signal sampled with the frequency that is two times the highest frequency of the first octave or higher.

The audio signal is then down-sampled, in operation S1020.

Thereafter, a filter bank is respectively applied to the down-sampled signal to obtain a scale of a second octave that is lower than the first octave, in operation S1030. In this example, the second octave may be an octave lower than the first octave by one octave, and the third octave may be an octave lower than the second octave by one octave.

Meanwhile, the received audio signal may be a compressed time-domain signal, and the control method may further include decoding the audio signal to acquire the PAM signal and information about the sampling frequency of the PAM signal.

In addition, in operation S1010 of obtaining the scale of the first octave, the PAM signal may be converted into a frequency-domain signal and the filter bank may be applied.

In this example, the filter bank may include a plurality of digital filters for filtering a frequency band corresponding to each of the plurality of target scales.

In addition, the plurality of digital filters may be band pass filters having a center frequency determined based on a sampling frequency of the received audio signal and a plurality of frequencies corresponding to each of the scales of the first octave.

In addition, the plurality of digital filters may be band pass filters each having the plurality of frequencies mentioned above as the center frequencies in the normalized frequency domain, and may be implemented such that when the sampling frequency is reduced to ½, each of the center frequencies is reduced to ½.

In addition, in operation S1020 of obtaining the scale of the second octave, the filter bank may be applied to a signal resulting from down-sampling the audio signal by ½, to obtain the scale of the second octave.

In addition, the control method may further include obtaining a scale of a third octave lower than a second octave, by applying a filter bank to a signal resulting from down-sampling the audio signal by ¼.

In addition, the electronic apparatus may include a plurality of light emitting elements. In this case, the control method may further include controlling the illuminating states of the plurality of light emitting elements based on the scales obtained from the outputted audio signal.

In this case, it may be possible to control at least one of the illumination time of the light emitting elements, and the number and intensity of illuminations of the light emitting elements corresponding to the scales based on the octave of the scales obtained from the outputted audio signal.

According to various exemplary embodiments, it may be possible to reduce the number of computations and obtain a scale in a wider frequency band than the FFT-based method used in conventional scale detection.

In addition, a desired result can be obtained only by obtaining the scales irrespective of octaves.

In addition, since the same digital filter is used, it is efficient in terms of memory. For example, when obtaining the scale of the sixth octave, without down-sampling, memory for six times greater computations and six times greater filters than for obtaining one octave are required. However, with the down-sampling, only the two times greater computations and amount of memory will suffice.

In addition, in a CPU (or DSP) with limited performance such as a Consumer Electronics (CE) device, it is enabled to obtain signal components at finer intervals such as twelve scales in a wide octave band at a sufficient resolution.

While not restricted thereto, an exemplary embodiment can be embodied as computer-readable code on a computer-readable recording medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network-coupled computer systems so that the computer-readable code is stored and executed in a distributed fashion. Also, an exemplary embodiment may be written as a computer program transmitted over a computer-readable transmission medium, such as a carrier wave, and received and implemented in general-use or special-purpose digital computers that execute the programs. Moreover, it is understood that in exemplary embodiments, one or more units of the above-described apparatuses and devices can include circuitry, a processor, a microprocessor, etc., and may execute a computer program stored in a computer-readable medium.

Further, at least some configurations of the methods according to various exemplary embodiments above may be implemented in the form of an application that can be installed on an existing electronic apparatus.

In addition, at least some configurations of the methods according to various exemplary embodiments above may be implemented with simple software or hardware upgrades for existing electronic apparatus.

In addition, at least some configurations of the methods according to various exemplary embodiments of the present disclosure described above may be performed through an embedded server provided in the electronic apparatus or an external server of the electronic apparatus.

The foregoing exemplary embodiments are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. An electronic apparatus, comprising:

an output interface, wherein the processor is configured to control the output interface to output an audio signal and identify scales included in the audio signal by applying a plurality of digital filters to the audio signal based on a sampling frequency of the audio signal, wherein the processor is further configured to:

identify scales of a first octave by applying the plurality of digital filters to the audio signal; and down-sample the audio signal and identify scales of a second octave lower than the first octave by applying the plurality of digital filters to the down-sampled audio signal, wherein each of center frequencies of the plurality of digital filters is reduced in proportion to the sampling frequency of the audio signal.

2. The electronic apparatus of claim 1, wherein the electronic apparatus further comprises:

an input interface configured to receive the audio signal which is a time-domain signal;

wherein the processor is configured to:

decode the input audio signal to acquire a pulse amplitude modulation (PAM) signal and information about a sampling frequency of the PAM signal;

convert the PAM signal into a frequency-domain signal; and apply the plurality of digital filter to the frequency-domain signal.

3. The electronic apparatus of claim 1, wherein the plurality of digital filters are band pass filters having center frequencies that are set based on a sampling frequency of the audio signal and a plurality of frequencies corresponding to each of a plurality of scales of the first octave.

4. The electronic apparatus of claim 1, wherein the plurality of digital filters have the plurality of frequencies as the center frequencies in a normalized frequency domain, and wherein each of the center frequencies of the plurality of digital filters is reduced to half of the center frequencies when the sampling frequency is reduced to half of the sampling frequency.

5. The electronic apparatus of claim 1, wherein the processor is further configured to:

obtain the scales of the second octave by applying the plurality of digital filters bank to the audio signal that is down-sampled by half; and obtain scales of a third octave that is lower than the second octave by applying the plurality of digital filters to the audio signal that is down-sampled by one fourth.

6. The electronic apparatus of claim 5, wherein the second octave is an octave lower than the first octave by one octave, and the third octave is an octave lower than the second octave by one octave.

7. The electronic apparatus of claim 1, wherein the first octave is a highest octave of a plurality of target octaves, and the audio signal is a signal sampled at two times the highest frequency of the first octave or higher.

8. The electronic apparatus of claim 1, further comprising a display comprising a plurality of light emitting elements, wherein the processor is further configured to control an illuminating state of the plurality of light emitting elements based on at least one octave of the scales of the first octave and the scales of the second octave.

9. The electronic apparatus of claim 8, wherein the processor is further configured to control at least one of an illumination time of the light emitting elements, and a number and an intensity of illuminations of the light emitting elements corresponding to the at least one octave of the scales of the first octave and the scales of the second octave.

10. A method of controlling an electronic apparatus, the method comprising:

outputting an audio signal; and identifying scales included in the audio signal by applying a plurality of digital filters to the audio signal based on a sampling frequency of the audio signal, the identifying scales included in the audio signal comprises:

identifying scales of a first octave by applying the plurality of digital filters to the audio signal;

down-sampling the audio signal, and identifying scales of a second octave that is lower than the first octave by applying the plurality of digital filters to the down-sampled audio signal, wherein each of the center frequencies of the plurality of digital filters is reduced in proportion to the sampling frequency of the audio signal.

11. The method of claim 10, wherein the method further comprises:

receiving an input audio signal which is a compressed time-domain signal; and decoding the input audio signal to obtain a pulse amplitude modulation (PAM) signal and information about a sampling frequency of the PAM signal, wherein the obtaining the scales of the first octave comprises converting the PAM signal into a frequency-domain signal and apply the plurality of digital filters to the frequency-domain signal.

12. The method of claim 10, wherein the plurality of digital filters are band pass filters having center frequencies that are set based on the sampling frequency and a plurality of frequencies corresponding to each scale of the first octave.

13. The method of claim 10, wherein the plurality of digital filters are band pass filters having the plurality of frequencies as the center frequencies in a normalized frequency domain, and each of the center frequencies is reduced to half of the center frequencies when the sampling frequency is reduced to half of the sampling frequency.

14. The method of claim 10, wherein the obtaining the scales of the second octave comprises obtaining the scales of the second octave by applying the plurality of digital filters to the audio signal by half, wherein the method further comprises obtaining scales of a third octave that is lower than the second octave by applying the plurality of digital filters to the audio signal that is down-sampled by one fourth.

15. A non-transitory computer readable storage medium storing a program that is executable by a computer to perform a method for controlling an electronic apparatus, wherein the method comprises:

outputting an audio signal; and identifying scales included in the audio signal by applying a plurality of digital filters to the audio signal based on a sampling frequency of the audio signal, the identifying scales included in the audio signal comprises:

identifying scales of a first octave by applying the plurality of digital filters to the audio signal;

down-sampling the audio signal; and identifying scales of a second octave that is lower than the first octave by applying the plurality of digital filters to the down-sampled audio signal, wherein each of the center frequencies of the plurality of digital filters is reduced in proportion to the sampling frequency of the audio signal.

16. An electronic apparatus, comprising:

an input interface configured to receive an audio signal;

a processor comprising:

a filter bank configured to identify scales of a first octave by applying a plurality of digital filters to the audio signal based on a sampling frequency of the audio signal;

at least one down-sampler configured to down-sample the audio signal;

wherein the filter bank is further configured to identify scales of a second octave that is lower than the first octave by applying the plurality of digital filters to the down-sampled audio signal, wherein each of center frequencies of the plurality of digital filters is reduced in proportion to the sampling frequency of the audio signal.

17. The electronic apparatus of claim 16, wherein the at least one down-sampler down-samples the audio signal a number of times, and the number of times is set based on a frequency interval between the first octave and a target octave that is to be obtained from the down-sampled audio signal.

18. The electronic apparatus of claim 16, wherein the at least one down-sampler is further configured to down-sample a frequency of the audio signal by half.

* * * * *